United States Patent [19]

Alford et al.

[11] 4,371,209

[45] Feb. 1, 1983

[54] MINING MACHINE STEERING EQUIPMENT

[75] Inventors: Derek Alford; Alan Wilkinson, both of Burton-on-Trent, England

[73] Assignee: Coal Industry (Patents) Limited, London, England

[21] Appl. No.: 219,193

[22] Filed: Dec. 22, 1980

[30] Foreign Application Priority Data

Feb. 1, 1980 [GB] United Kingdom ..... 8003503

[51] Int. Cl.[3] ..... E21C 35/10; E21C 35/24

[52] U.S. Cl. ..... 299/1

[58] Field of Search ..... 299/1

[56] References Cited

U.S. PATENT DOCUMENTS 4,008,921 2/1977 Czauderna et al. ..... 299/1

4,072,349 2/1978 Hartley ..... 299/1

FOREIGN PATENT DOCUMENTS 1203362 8/1970 United Kingdom ..... 299/1

1443227 7/1976 United Kingdom .

1483318 8/1977 United Kingdom .

*Primary Examiner*—Ernest R. Purser

*Attorney, Agent, or Firm*—James C. Wray

[57] ABSTRACT

A mining machine comprising a ranging drum having two operational positions adjacent to the mine roof and to the mine floor, respectively, is provided with machine steering equipment comprising a component having two operational modes associated with the two operational positions of the cutter head, respectively, actuator means for urging the component into one or other of the two operational modes, and sensor means for sensing the position of the component and for deriving a signal indicative of the sensed component position.

27 Claims, 6 Drawing Figures

MINING MACHINE STEERING EQUIPMENT

The present invention relates to mining machine steering equipment and in particular to equipment for use with mining machines including cutter means carried on pivotally mounted booms or arms.

One known such mining machine is commonly called a ranging drum shearer and comprises at least one rotary cutter drum or head carried on an arm pivotally mounted on the machine body. The arm is pivoted about its pivotal mounting by a hydraulic jack which controls the angular position of the arm to raise or lower the cutter drum to a desired height. In coal mining practice a machine having a single rotary cutter traverses to and fro along a working face winning a strip of coal from the working face every two traverses. The thickness of coal won on each strip is typically somewhat less than twice the cutting diameter of the cutter drum so that on one traverse the machine wins coal adjacent the mine roof and on the following traverse wins coal adjacent to the mine floor.

With a prior known ranging drum shearer the cutter drum is raised or lowered to steer the machine by an operator who has to estimate the cutting horizon of the cutter drum. As the operator is remote from the cutter drum which is surrounded by dust generated during cutting, the steering often is erratic resulting in roof and/or floor rock being mined or in an excessive amount of coal being left unmined.

Techniques have been proposed for automatically steering ranging drum shearer using well known systems developed with fixed drum shearers ie machines having the axis of each cutter drum fixed with respect to the machine body. However, because of problems encountered including determining the vertical position of the ranging cutter drum with respect to the machine body the proposed techniques have not been completely successful. Also systems for adapting the known fixed drum techniques tend to have become complicated requiring involved sensing and control arrangements.

An object of the present invention is to provide improved mining machine steering equipment for use with a machine including a cutter drum or head mounted for vertical movement with respect to the machine's body, the equipment tending to be reliable and simple.

According to the present invention mining machine steering equipment for use with a mining machine including a cutter drum or head mounted for movement between two operational positions comprises a component having two operational modes associated with the two operational positions of the cutter drum or head, respectively, actuator means for urging the component into one or other of the two operational modes, and sensor means for sensing the position of the component and for deriving a signal indicative of the sensed component position.

Preferably, the component is adapted to pivot about a mounting for the cutter drum or head.

Preferably, the component is adapted to sense rock or mineral profiles formed by the cutter drum or head.

Preferably, the rock or mineral profiles sensed by the component when in the different operational modes are formed by the cutter drum or head in one operational position.

Advantageously, the actuator means is adapted to urge the component towards one or other of the rock or mineral profiles formed by the cutter drum or head.

Preferably, the component is urged by the actuator means to abut the rock or mineral profiles.

Preferably, the component is adapted to abut a rock or mineral profile formed by the cutter drum or head on a previous traverse along the working face.

Conveniently, the component has two abutment formations associated with the two operational modes, respectively.

Preferably, the actuator means comprises a hydraulic motor arranged to urge the component towards one or other of its operational modes.

Advantageously, the sensor means is adapted to sense the operational position of the hydraulic motor.

Alternatively, the sensor means is adapted to sense the operational position of mechanism drivably connected to the associated hydraulic motor and to the associated component.

Preferably, signal processing means are provided to receive the signals indicative of the sensed component positions associated with the two operational modes, the signal processing means deriving a steering control signal.

Preferably, steering control means are provided to receive the steering control signal and for controlling pivotal movement of the boom or arm with the cutter drum or head in at least one operational position such that, in use, a preselected thickness of rock and/or mineral is won.

The present invention also provides mining machine steering equipment for use with a mining machine including two cutter drums or heads each mounted for movement between two operational positions, the equipment comprising two components associated with the cutter drums or heads, respectively, and each having two operational modes associated with the two operational positions of the associated cutter drum or head, respectively, actuator means for urging each of the components into one or other of its operational modes, and sensor means for sensing the position of each of the components and for deriving signals indicative of the sensed component positions.

Preferably at least one component in one operational position is adapted to sense the rock or mineral profile formed by the cutter drum or head associated with the other of the components.

Advantageously, at least one component in one operational position is adapted to sense the rock or mineral profile formed by the cutter drum or head associated with the other of the components, the sensed rock or mineral profile being formed on a previously traverse of the machine along the working face.

Advantageously, the components are adapted to pivot around a mounting for the associated cutter drum or head.

Preferably, the actuator means associated with each component comprises a hydraulic motor arranged to urge the component towards one or other of its operational modes.

Advantageously, the sensor means is adapted to sense the operational position of the hydraulic motor.

Alternatively, the sensor means is adapted to sense the operational position of mechanism drivably connected to the associated hydraulic motor and to the associated component.

Conveniently, each component has two abutment formations associated with the two operational modes, respectively.

Preferably, signal processing means are provided to receive the signals indicative of the sensed component positions and to derive a steering control signal.

Preferably, steering control means are provided to receive the steering control signal, the steering control means being adapted to control pivotal movement of at least one of the booms or arms such that, in use, a preselected thickness of rock and/or mineral is won by the two cutter drums or heads.

The present invention also provides a mining machine comprising a body adapted to traverse to and fro along a working face, a boom or arm pivotally mounted on the body, a cutter drum or head mounted on the boom or arm and movable between two operational positions on pivotal movement of the boom or arm, and machine steering equipment comprising a component having two operational modes associated with the two operational positions of the cutter drum or head, respectively, actuator means for urging the component into one or other of the two operational modes, and sensor means for sensing the position of the component and for deriving a signal indicative of the sensed component position.

Preferably, the component is adapted to pivot about a mounting for the cutter drum or head.

Preferably, the component is adapted to sense rock or mineral profiles formed by the cutter drum or head.

Preferably, the rock or mineral profiles sensed by the component when in the different operational modes are formed by the cutter drum or head in one operational position.

Advantageously, the actuator means is adapted to urge the component towards one or other of the rock or mineral profiles formed by the cutter drum or head.

Preferably, the component is urged by the actuator means to abut the rock or mineral profiles.

Preferably, the component is adapted to abut a rock or mineral profile formed by the cutter drum or head on a previous traverse along the working face.

Conveniently, the component has two abutment formations associated with the two operational modes, respectively.

Preferably, the actuator means comprises a hydraulic motor arranged to urge the component towards one or other of its operational modes.

Advantageously, the sensor means is adapted to sense the operational position of the hydraulic motor.

Alternatively, the sensor means is adapted to sense the operational position of mechanism drivably connected to the associated hydraulic motor and to the associated component.

Preferably, signal processing means are provided to receive the signals indicative of the sensed component positions associated with the two operational modes, the signal processing means deriving a steering control signal.

Preferably, steering control means are provided to receive the steering control signal and to control pivotal movement of the boom or arm with the cutter drum or head in at least one operational position such that, in use, a preselected thickness of rock and/or mineral is won.

The present invention also provides a mining machine comprising a body adapted to traverse to and fro along a working face, two booms or arms pivotally mounted on the body, two cutter drums or heads mounted on the booms or arm, respectively, and each movable between two operational positions on pivotal movement of the associated boom or arm, and machine steering equipment comprising two components associated with the cutter drums or heads, respectively, and each component having two operational modes associated with the two operational positions of the associated cutter drum or head, respectively, actuator means for urging each of the components into one or other of its operational modes, and sensor means for sensing the position of each of the components and for deriving signals indicative of the sensed component positions.

Preferably, at least one component in one operational position is adapted to sense the rock or mineral profile formed by the cutter drum or head associated with the other of the components.

Advantageously, at least one component in one operational position is adapted to sense the rock or mineral profile formed by the cutter drum or head associated with the other of the components, the sensed rock or mineral profile being formed on a previous traverse of the machine along the working face.

Advantageously, the components are adapted to pivot around a mounting for the associated cutter drum or head.

Preferably, the actuator means associated with each component comprises a hydraulic motor arranged to urge the component towards one or other of its operational modes.

Advantageously, the sensor means is adapted to sense the operational position of the hydraulic motor.

Alternatively, the sensor means is adapted to sense the operational position of mechanism drivably connected to the associated motor and to the associated component.

Preferably, signal processing means are provided to receive the signals indicative of the sensed component positions and to derive a steering control signal.

Preferably, steering control means are provided to receive the steering control signal and to control pivotal movement of at least one of the booms or arms such that, in use, a thickness of rock and/or mineral is won by the two cutter drums or head.

By way of example, two embodiments of the present invention will now be described with reference to the accompanying drawings, in which.

Figure 1:
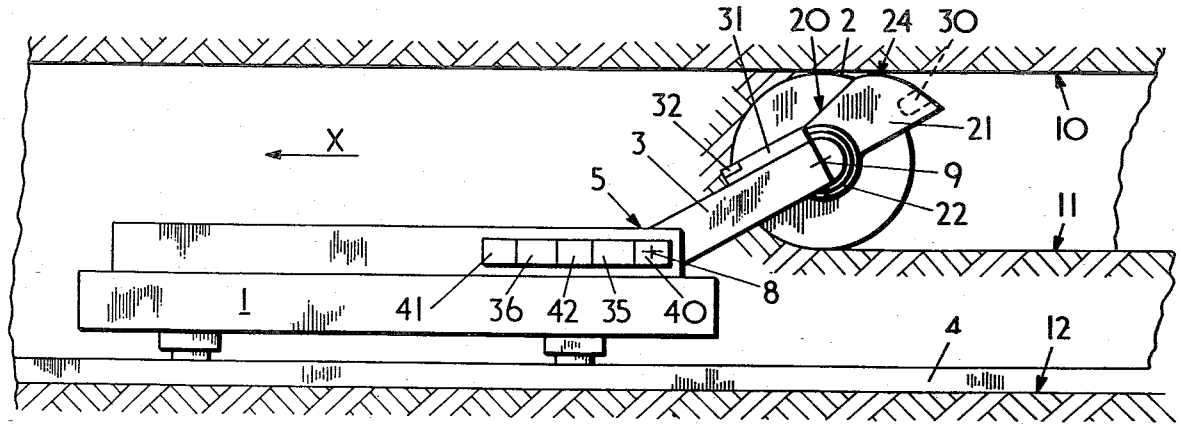
FIG. 1 is an incomplete side view of a mining machine including machine steering equipment and constructed in accordance with one embodiment of the present invention, the machine being shown in one operational position.

FIGS. 1 to 5 show a ranging drum shearer coal mining machine which comprises a body 1 and a rotary cutter drum or head 2 mounted on an arm or boom 3 and which in operation repeatedly traverses to and fro along an armoured face conveyor 4 extending along a longwall working face such that the rotating cutter drum wins and loads coal from the working face. The single arm 3 is supported in a pivotal mounting 5 for pivotal movement about a generally horizontal axis 8, the pivot movement being controlled by a hydraulic ram (not shown) connected between the body and the arm. An electric drive motor housed within the body of the machine is drivably connected to gear mechanisms extending along the arm to drivably engage the cutter drum which thereby is rotated about an axis 9.

The arrangement is such that as the machine traverses along the working face in one direction (indicated by arrow x in FIG. 1) the cutter arm is raised such that the cutter drum is in a raised operational position adjacent to the mine roof 10. In this position the cutter drum forms two rock or mineral cut profiles 10 (ie the mine roof) and a lower bench profile 11.

When the machine next traverses along the working face in the opposite direction (indicated by arrow Y in FIG. 3) the cutter arm is lowered such that the cutter drum is in a lowered operational position adjacent to the mine floor 12. In this position the cutter drum forms one rock or mineral cut profile 12 (ie the mine floor) and removes the rock or mineral left by the machine on its previous traverse in the direction x, ie the cutter drums removes the rock or mineral below the previously formed bench profile 11.

Figure 5:
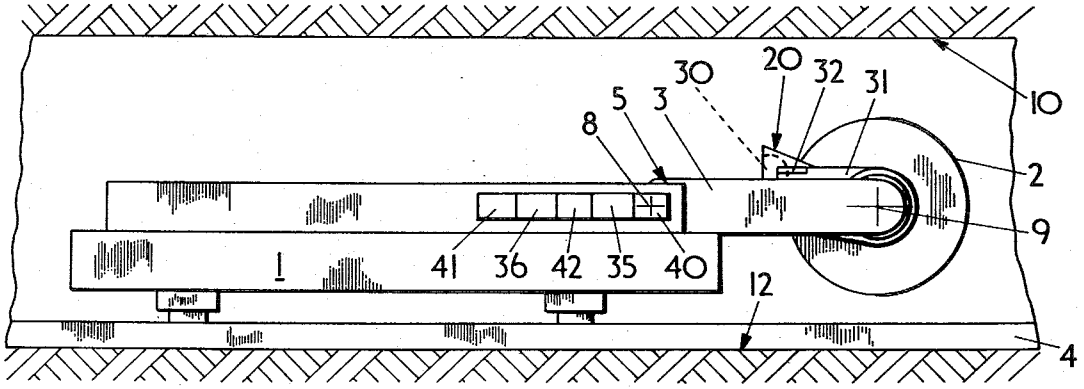
FIG. 5 is an incomplete side view similar to FIGS. 1 and 3 but showing the machine in a further alternative operational position.

In FIG. 5 the machine is shown with the cutter arm substantially horizontal such that the cutter drum is remote from the mine roof and floor boundaries enabling the machine to flit or traverse along the face at relatively high speed. During flitting the cutter drum does not contact the working face and no rock or mineral is won.

The drive motor on the machine is arranged to engage gearing which in turn engages a stationary chain or track (not shown) enabling the machine to haul itself along the working face. In some machines separate haulage and cutter motors are provided.

Alternatively, the machine is hauled along the working face by a moving component, for example a chain, hauled by a motor remote from the machine.

Figure 2:
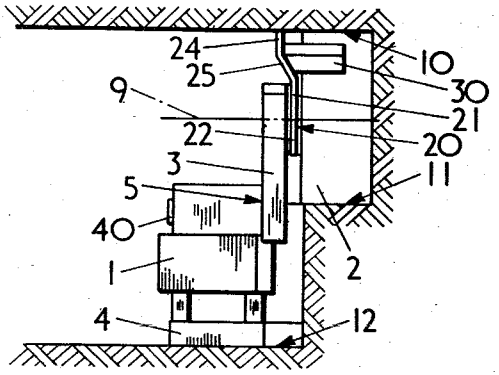
FIG. 2 is an incomplete end view of FIG. 1.
Figure 3:
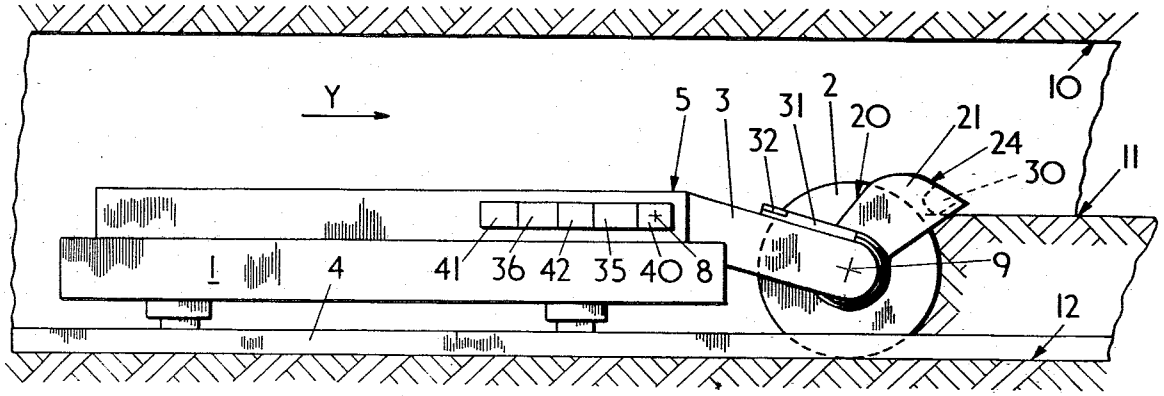
FIG. 3 is an incomplete side view similar to FIG. 1 but showing the machine in an alternative operational position.

The mining machine of FIGS. 1 to 5 is provided with machine steering equipment comprising a component 20 having two operational modes associated with the two operational positions of the cutter drum, as indicated in FIGS. 1 and 3, respectively. The component 20 comprises a cranked plate 21 having a bearing portion 22 pivotally mounted around the mounting 5 for the cutter drum for pivotal movement about the axis 9. The plate 21 has a curved abutment formation 24 for abuting the mine roof 10. As seen in FIG. 2 the plate 21 is cranked towards the machine body at 25 such that the abutment formation 24 abuts the mine roof formed during the previous mine roof forming traverse of the machine along the working face.

Figure 4:
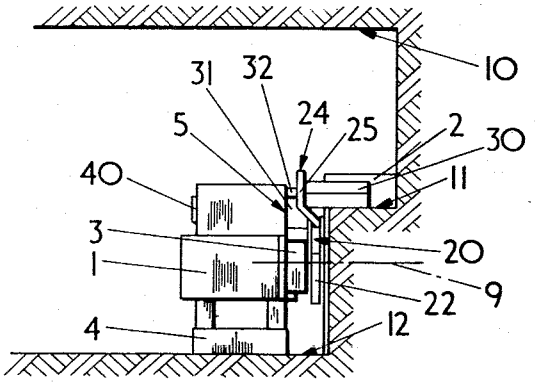
FIG. 4 is an incomplete end view of FIG. 3.

The component 20 also comprises a further abutment formation 30 constituted by a bar projecting transversely from the plate 21 to overlap the cutting width of the cutter drum (see particularly FIGS. 2 and 4). From FIGS. 3 and 4 it can be seen that as the machine traverses along the face cutting in the direction of arrow Y the abutment formation 30 abuts the bench profile 11 left by the machine during its previous cutting transverse in the direction x.

When in either of its two operation modes the component is urged into contact with the associated previously formed rock or mineral profile 10 or 11 by actuator means 31 comprising a hydraulic motor (not shown) which drivably engages mechanisms (not shown) for example, a movable rock engageable by a pinion on the motor, and thereby tends to urge the component to pivot about this axis 9 towards the respective cut profile.

Sensor means 32 are provided to sense the operational position of the mechanism and thereby determine the angular position of the component with respect to the arm 3, the sensed angular position of the component being proportional to the vertical distance of the pivotal axis 9 (ie the rotational axis of the rotary cutter drum 2) from the formed rock or mineral profile 10 or 11. The sensor means 32 derives a signal indicative of the current angular position of the component 20, the signals being fed to signal processing means 35 which processes the received signals to derive a steering control signal which is fed to steering control means 36 which in turn control the angular position of the arm with the cutter drum in at least one operational position to control the thickness of rock and/or mineral won during the two traverses of the machine to a preselected desired thickness.

In order to process the signals to determine the desired angular position of the arm the processing means 35 also is fed with a signal derived by sensor means 40 and indicative of the current angular position of the arm 3 relative to the machine body 1 and by a further signal derived by sensor means 41 and indicative of the position of the machine along the working face. The processing means 35 includes memory means 42 enabling the processing means to process signals received with the machine the same distance along the working face but on different transverses of the working face.

Thus, in operation as the machine repeatedly traverses to and fro along the working face the processing means 35 continuously receives and processes signals derived by the sensor means 32, 40 and 41 such that the cutting horizon of the cutter drum 2 is maintained at a desired position and a desired thickness of rock and/or mineral is won on each pair of traverses along the working face.

With the cutter drum 2 in its raised operational position (as seen in FIGS. 1 and 2) the curved abutment formation 24 of the component 20 is urged to contact the mine roof 10 formed by the cutter drum on its previous traverse along the face. The processing means 35 including the memory means 42 receives signals from the sensor means 40 which are indicative of the position of the cutter drum on the current traverse and from the sensor means 32 which are indicative of the position of the cutter drum on the previous traverse and by comparing the two signals a steering control signal is derived which is indicative of any significant discrepancy between the two sensed positions of the cutter drum. The steering control signal is fed to the steering control means 36 which thereby if necessary suitably adjusts the angular position of the arm 3 to apply a steering correction to the current drum position.

When cutting in the direction indicated by arrow Y with the cutter drum in the lower operational position the abutment formation 30 senses the current position of the lower bench profile 11 left by the raised cutter drum on the previous traverse of the face. The processing means 35 including the memory means 42 processes the signals derived by the sensor means 32 and 40 on the present traverse and on the previous traverse to determine the total thickness of rock and/or mineral won. If the total sensed thickness of rock and/or mineral won differs significantly from a preselected desired thickness the processing means 35 derives a steering control signal which is fed to the steering control means 36 which thereby suitably adjusts the position of the lowered cutter drum.

It will be appreciated that with the above described steering equipment it should be possible, once the equipment is set up and with reasonably stable mining conditions to automatically steer the mining machine.

Figure 6:
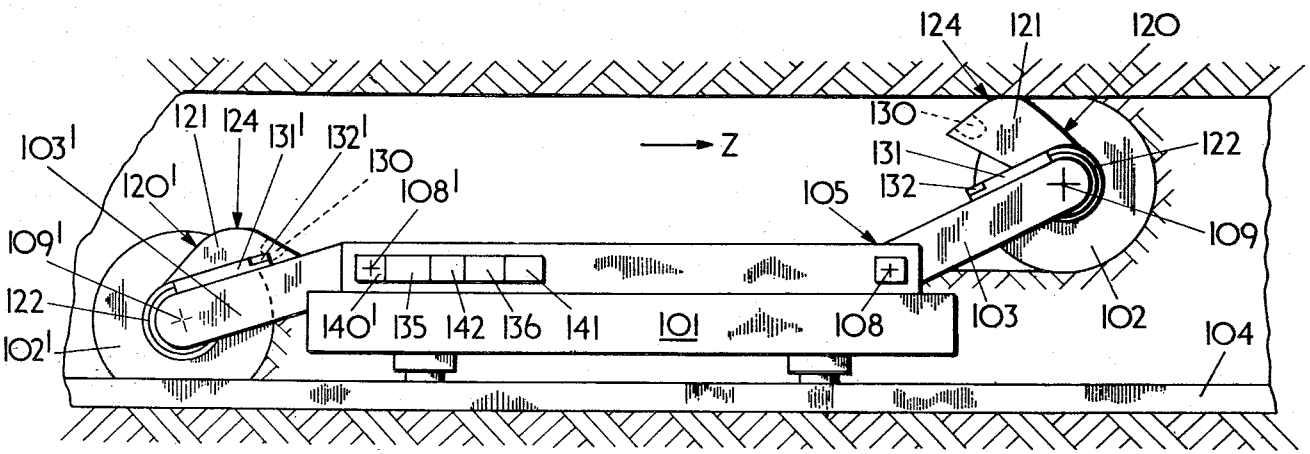
FIG. 6 is an incomplete side view of a mining machine including machine steering equipment and constructed in accordance with a second embodiment of the present inventicn.

FIG. 6 shows a second embodiment of the present invention comprising a ranging drum shearer coal mining machine including a body 101 and two rotary cutter drums or heads 102 and 102' mounted on arms or booms 103 and 103', respectively. In operation the machine repeatedly traverses to and fro along an armoured face conveyor 104 extending along a longwall working face such that the rotary cutter drums simultaneously win and load coal from the working face. The two arms 103 and 103' are supported in pivotal mountings 105 and 105' for pivotal movement about generally horizontal axes 108 and 108', respectively. Pivotal movement of each arm is controlled by a hydraulic ram (not shown) connected between the machine body and the associated arm. One or more electric drive motors housed within the body 1 is drivably connected to gear mechanisms extending along the arms to drivably engage the cutter drums which thereby are simultaneously rotated about axes 109 and 109', respectively.

The arrangement is such that as the machine traverses along the working face in one direction (indicated by arrow Z in FIG. 6) the currently leading cutter drum 102 is in a raised operational position forming two rock or mineral cutting profiles 110 (ie the mine roof) and 111 (ie a lower bench profile). The currently trailing cutter drum 102' is in a lowered operational position forming one rock or mineral cutting profile 112 (ie the mine floor). The trailing cutter drum removes the rock or mineral left by the leading cutter drum.

When the machine reaches the end of the working face the hydraulic rams are actuated such that the cutter arm 103 is lowered to move the cutter drum 102 into a lowered operational position to form the mine floor 112 and the cutter arm 103' is raised to move the cutter drum 102' into a raised operational position to form the mine roof 110. Once the two cutter drums are in their new operational modes the machine is traversed along the work face in a direction opposite to direction Z, the roles of the cutter drums being substantially reversed to those indicated in FIG. 6.

As seen in FIG. 6 the machine has machine steering equipment comprising two components 120 and 120' associated with the cutter drums 102 and 102', respectively. Each component has two operational modes associated with the two operational positions of the cutter drum, respectively. Each component comprises a cranked plate 121 having a bearing portion 122 pivotally mounted around the mounting 105, 105' for the associated cutter drum for pivotal movement about the axis 109, 109'. The plate 121 has a curved abutment formation 124 for abutting the mine roof 110. In similar manner to the first described embodiment the plate 121 is cranked towards the machine body such that the abutment formation 124 abuts the mine roof formed during the previous traverse of the machine along the working face.

The component 20 also comprises a further abutment formation 130 constituted by a bar projecting transversely from the plate 121 to overlap the cutting width of the cutter drum. As indicated in FIG. 6 as the machine traverses along the working face the abutment formation 130 associated with the currently trailing cutter drum abuts the bench profile 111 left by the currently leading cutter drum.

When in either of their two operational modes each of the components is urged into contact with the associated previously formed rock or mineral profile 110 or 111 by actuator means 131, 131' each comprising a hydraulic motor (not shown) which drivably engages mechanism (not shown) for example a movable rack engageable by a pinion on the motor, and thereby tends to urge the component to pivot about the associated axis 109, 109' towards the respective cut profile.

Sensor means 132, 132' are provided to sense the operational position of the mechanism and thereby determine the angular position of the component with respect to the associated arm, the sensed angular position of the component being proportional to the vertical distance of the associated pivotal axis 109, 109' (ie the rotational axes of the rotary cutter drums) from the formed rock or mineral profiles 110, 111.

Each of the sensor means 132, 132' derives a signal indicative of the current angular position of the associated component, the signals being fed to common signal processing means 135 which processes the received signals to derive a steering control signal which is fed to steering control means 136 which in turn control the angular position of at least the currently trailing cutter arm to control the thickness of rock and/or mineral won during the traverse of the machine along the working face, the thickness being controlled to a preselected desired value.

In order to process the signals to determine the desired angular position of the arms the processing means 135 also is fed with signals derived by sensor means 140 and 140' indicative of the current angular position of the arms 103 and 103' with respect to the machine body 101, and by a further signal derived by sensor means 141 and indicative of the position of the machine along the working face. The processing means includes memory means 142 enabling the processing means to process signals received and to identify the received signals with the position of the current machine along the working face.

Thus, in operation, as the machine repeatedly traverses to and fro along the working face the processing means 135 continuously receives and processes signals derived by the sensor means 132, 132', 140, 140' and 141 such that the cutting horizon of the cutter drums are maintained at a desired position relative to the rock or mineral seam being won and a preselected desired thickness of rock and/or mineral is won on each traverse of the machine along the working face.

With the machine cutting in a direction indicated by arrow Z in FIG. 6 the leading cutter drum 102 is in its raised operational position with the curved abutment formation 124 of the component 120 urged to contact the mine roof 110 formed by the cutter drum 102' on the previous traverse of the machine along the face. The processing means 135 including the memory means 142 receives signals from the sensor means 140 which are indicative of the position of the cutter drum 102 on the current traverse and from the sensor means 132 which are indicative of the position of the cutter drum 102' on the previous traverse and by comparing the two signals a steering control signal is derived which is indicative of any significant discrepancy between the two sensed positions of the cutter drums. The steering control signal is fed to the steering control means 136 which thereby, if necessary, suitably adjusts the angular position of the arm 103 to apply a steering correction to the current leading drum position.

As seen in FIG. 6, the abutment formation 130 of the component 120' associated with the trailing lowered cutter drum 102' senses the current position of the lower bench profile 111 left by the leading raised cutter drum 102. The processing means 135 processes the signals derived by the sensor means 140, 140', 132 and 132' to determine the total thickness of rock and/or mineral won. If the total sensed thickness of rock and/or mineral won differs significantly from a preselected desired thickness the processing means 135 derives a steering control signal which is fed to the steering control means 36 which thereby suitably adjusts the position of the currently trailing lowered cutter drum 102'.

It will be appreciated that with the above described steering equipment it should be possible, once the equipment is set up and with reasonably stable mining conditions to automatically steer a double ended ranging drum shearer substantially as shown in FIG. 6, the two cutter drums 102, 102' being maintained at desired cutting horizons.

In other embodiments of the invention the plate 20 is not cranked towards the mining machine body.

In still other embodiments the means for determining the position of the machine along the working face is dispensed with.

In still further embodiments of the invention the formation 30 is bridge-shaped to sense the bench 11 at a location adjacent to the generally vertical rock and/or mineral face.

We claim:

1. Mining machine steering equipment for use with a mining machine including a cutter drum or head mounted on a ranging arm for movement between two operational positions, comprising a component having two operational modes associated with the two operational positions of the cutter drum or head, respectively, actuator means for urging the component into one or other of the two operational modes, and sensor means for sensing the angular position of the component with respect to the arm and for deriving a signal indicative of the sensed angular position of the component.

2. Equipment as claimed in claim 1, in which the component is adapted to pivot about a mounting for the cutter drum or head.

3. Equipment as claimed in claim 2, in which the component is adapted to sense rock or mineral profiles formed by the cutter drum or head.

4. Equipment as claimed in claim 3, in which the rock or mineral profiles sensed by the component when in the different operational modes are formed by the cutter drum or head in one operational position.

5. Equipment as claimed in claim 4, in which the actuator means is adapted to urge the component towards one or other of the rock or mineral profiles formed by the cutter drum or head.

6. Equipment as claimed in claim 5, in which the component is adapted to abut a rock or mineral profile formed by the cutter drum or head on a previous traverse along the working face.

7. Mining machine steering equipment for use with a mining machine including a cutter drum or head mounted for movement between two operational positions, comprising a component pivotable about a mounting for the cutter drum or head having two operational modes associated with the two operational positions of the cutter drum or head, respectively, for sensing rock or mineral profiles formed by the cutter drum or head in one operational position, actuator means for urging the component towards one or other of the rock or mineral profiles into one or other of the two operational modes, said component having two abutment formations for engaging the sensed rock or mineral profile associated with the two operational modes, respectively, and being adapted to abut a rock or mineral profile formed by the cutter drum or head on a previous traverse along the working face, and sensor means for sensing the position of the component and for deriving a signal indicative of the sensed component position.

8. Equipment as claimed in claim 7, in which signal processing means are provided to receive the signals indicative of the sensed component positions associated with the two operational modes, the signal processing means deriving a steering control signal.

9. Equipment as claimed in claim 8, in which steering control means are provided to receive the steering control signal for controlling pivotal movement of the boom or arm with the cutter drum or head in at least one operational position such that, in use, a preselected thickness of rock and/or mineral is won.

10. Mining machine steering equipment for use with a mining machine including two cutter drums or heads each mounted on a ranging arm for movement between two operational positions, the equipment comprising two components associated with the cutter drums or heads, respectively, and each having two operational modes associated with the two operational positions of the associated cutter drum or head, respectively, actuator means for urging each of the components into one or other of its operational modes, and sensor means for sensing the angular position of each of the components with respect to the associated ranging arm and for deriving signals indicative of the sensed angular position of the component.

11. Equipment as claimed in claim 10, in which at least one component in one operational position is adapted to sense the rock or mineral profile formed by the cutter drum or head associated with the other of the components.

12. Equipment as claimed in claim 11, in which at least one component in one operational position is adapted to sense the rock or mineral profile formed by the cutter drum or head associated with the other of the components, the sensed rock or mineral profile being formed on a previous traverse of the machine along the working face.

13. Mining machine steering equipment for use with a mining machine including two cutter drums or heads each mounted for movement between two operational positions, the equipment comprising two components associated with the cutter drums or heads, respectively, and each having two operational modes associated with the two operational positions of the associated cutter drum or head, respectively, at least one component in one operational position being adapted to sense a rock or mineral profile formed by the cutter drum or head associated with the other of the components on a previous traverse of the mining machine along the working face, actuator means for urging each of the components into one or other of its operational modes, and sensor means for sensing the position of each of the components and for deriving signals indicative of the sensed component positions, wherein each component has two abutment formations for engaging the sensed rock or mineral profile associated with the two operational modes respectively.

14. Equipment as claimed in claim 13, in which signal processing means are provided to receive the signal indicative of the sensed component positions and to derive a steering control signal.

15. Equipment as claimed in claim 14, in which steering control means are provided to receive the steering control signal, the steering control means being adapted to control pivotal movement of at least one of the booms or arms such that, in use, a preselected thickness of rock and/or mineral is won by the two cutter drums or heads.

16. A mining machine comprising a body adapted to traverse to and fro along a working face, a boom or arm pivotally mounted on the body, a cutter drum or head mounted on the boom or arm and movable between two operational positions on pivotal movement of the boom or arm, and machine steering equipment comprising a component having two operational modes associated with the two operational positions of the cutter drum or head respectively, actuator means for urging the component into one or other of the two operational modes, and sensor means for sensing the angular position of the component with respect to the boom or arm and for deriving a signal indicative of the sensed angular position of the component.

17. A machine as claimed in claim 16 in which the component is adapted to sense rock or mineral profiles formed by the cutter drum or head.

18. A machine as claimed in claim 17, in which the rock or mineral profiles sensed by the component when in the different operational modes are formed by the cutter drum or head in one operational position.

19. A machine as claimed in claim 18, in which the actuator means is adapted to urge the component towards one or other of the rock or mineral profiles formed by the cutter drum or head.

20. A machine as claimed in claim 19, in which the component is adapted to abut a rock or mineral profile formed by the cutter drum or head on a previous traverse along the working face.

21. A machine as claimed in claim 20, in which signal processing means are provided to receive the signals indicative of the sensed component positions associated with the two operational modes, the signal processing means deriving a steering control signal.

22. A machine as claimed in claim 21, in which steering control means are provided to receive the steering control and to control pivotal movement of the boom or arm with the cutter drum or head in at least one operational position such that, in use, a preselected thickness of rock and/or mineral is won.

23. A mining machine comprising a body adapted to traverse to and fro along a working face, two booms or arms pivotally mounted on the body, two cutter drums or heads mounted on the booms or arms, respectively, and each movable between two operational positions on pivotal movement of the associated boom or arm, and machine steering equipment comprising two components associated with the cutter drums or heads, respectively, and each component having two operational modes associated with the two operational positions of the associated cutter drum or head, respectively, actuator means for urging each of the components into one or other of its operational modes, and sensor means for sensing the angular position of each of the components with respect to the associated boom or arm and for deriving signals indicative of the sensed angular position of the component.

24. A mining machine as claimed in claim 23, in which at least one component in one operational position is adapted to sense the rock or mineral profile formed by the cutter drum or head associated with the other of the components.

25. A mining machine as claimed in claim 24, in which at least one component in one operational position is adapted to sense the rock or mineral profile formed by the cutter drum or head associated with the other of the components, the sensed rock or mineral profile being formed on a previous traverse of the machine along the working face.

26. A mining machine as claimed in claim 25, in which processing means are provided to receive the signals indicative of the sensed component positions and to derive a steering control signal.

27. A mining machine as claimed in claim 26, in which steering control means are provided to receive the steering control signal and to control pivotal movement of at least one of the booms or arms such that, in use, a preselected thickness of rock and/or mineral is won by the two cutter drums or head.

* * * * *